United States Patent [19]

Leech, III et al.

[11] Patent Number: 4,505,297

[45] Date of Patent: Mar. 19, 1985

[54] STEAM DISTRIBUTION MANIFOLD

[75] Inventors: Charles A. Leech, III; Thomas J. Rancudo, Jr., both of Houston, Tex.; James W. Groman, Flagstaff, Ariz.

[73] Assignee: Shell California Production Inc., Houston, Tex.

[21] Appl. No.: 519,447

[22] Filed: Aug. 2, 1983

[51] Int. Cl.[3] ..... F25B 39/02

[52] U.S. Cl. ..... 137/561 A; 62/525

[58] Field of Search ..... 137/561 R, 561 A; 62/525

[56] References Cited

U.S. PATENT DOCUMENTS

| | | | |
|---|---|---|---|
| 2,110,430 | 3/1938 | Swanson | 137/561 A |
| 2,803,116 | 8/1957 | Tilney | 62/525 |
| 3,395,730 | 8/1968 | Mennesson | 137/561 R |
| 3,795,259 | 3/1974 | Brandin et al. | 62/525 |
| 3,864,938 | 2/1975 | Hayes, Jr. | 62/525 |
| 3,899,000 | 8/1975 | Ohlswager et al. | 137/561 A |
| 4,256,140 | 3/1981 | Swaroop et al. | 137/561 A |

*Primary Examiner*—A. Michael Chambers

[57] ABSTRACT

An apparatus for dividing a single stream vapor-liquid mixture into a plurality of individual streams while maintaining substantially the same vapor-liquid ratio in each of the individual streams. The apparatus comprises a closed vessel having a central inlet in the top for the single stream and a plurality of outlets in the side of the vessel for the individual streams. A frustum shaped diverting member is mounted in the center of the vessel to divert the flow of the single stream into the individual streams. A bottom drain is provided for removing any liquid that is separated from the vapor-liquid mixture.

12 Claims, 2 Drawing Figures

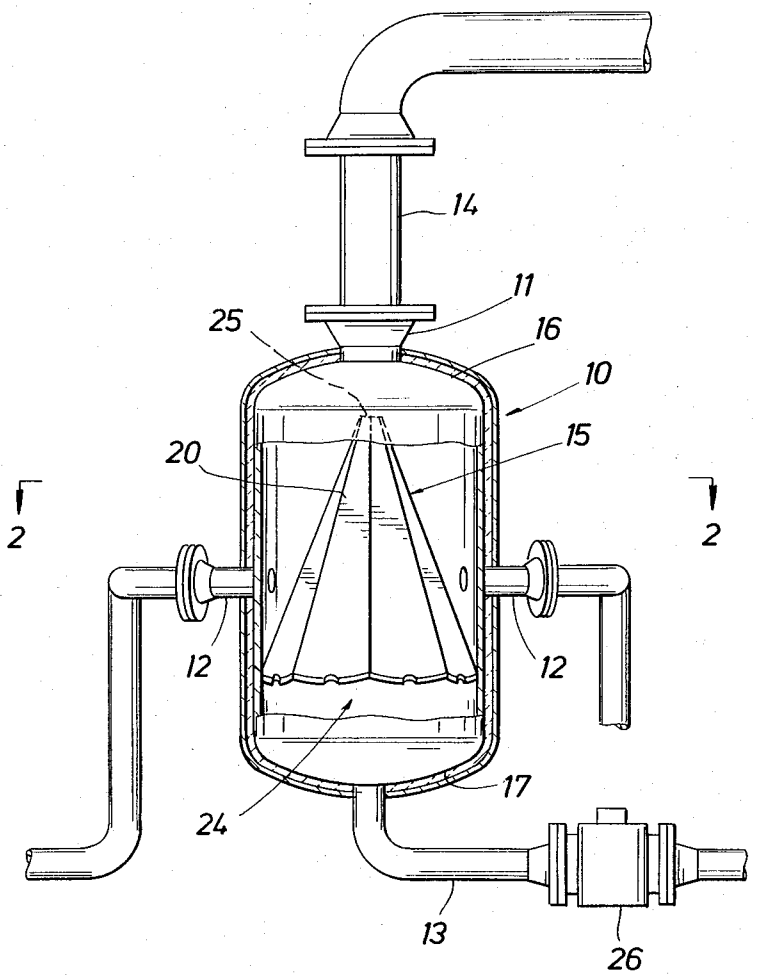
FIG. 1
FIG. 2
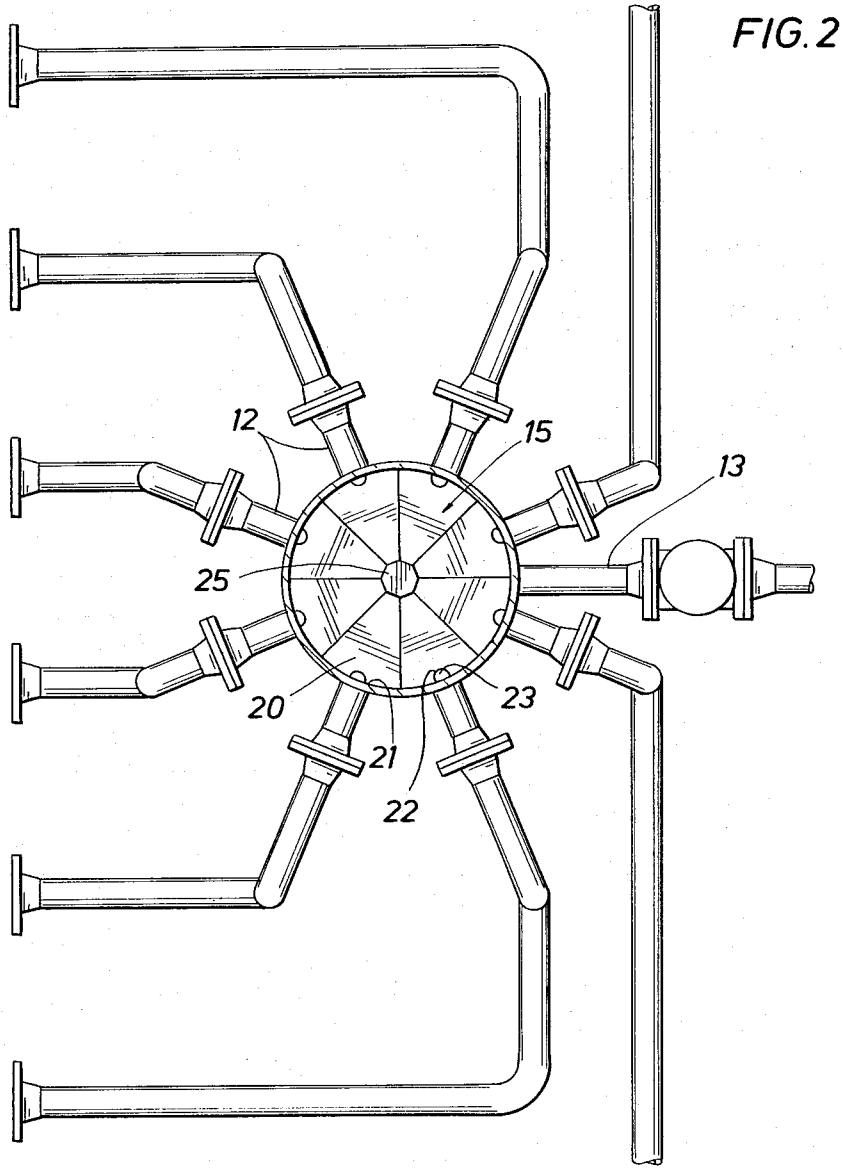

STEAM DISTRIBUTION MANIFOLD

BACKGROUND OF THE INVENTION

The present invention relates to distributing apparatus and particularly to an apparatus which is designed to divide a single, two-phase, vapor-liquid stream into a plurality of individual streams in which each of the individual streams has substantially an equal ratio of vapor to liquid. In many processes a main two-phase, vapor-liquid flow must be divided into several individual streams while maintaining an equal liquid-vapor ratio in the individual streams. For example, a central facility may be used to supply process heat in the form of high-quality, two-phase steam to several individual processes or locations. It is necessary that the main stream flow be divided into several individual flows to supply the individual location. It is obvious that one must maintain an equal vapor-liquid ratio in each of the individual branch flows or the individual flows may consist primarily of water and very little steam or vice versa.

In thermal enhanced oil recovery (EOR) projects steam is injected into hydrocarbon bearing formations to increase production. In these systems it is very common to use high-quality, two-phase steam, for example, 80% quality steam. The practice of generating two-phase steam is necessitated by the use of low quality or brackish (produced) waters with moderate dissolved solids contents in the process. To prevent deposition of salts on the surfaces of the steam generator tubes, it is necessary to retain part of the flow in a liquid state in order to maintain the solids and other impurities in solution. If it is necessary to distribute this steam to individual injection wells, the problem arises of dividing the main flow into the individual flows while maintaining the ratio between vapor and water in the individual flows.

The above problem of thermal EOR projects will increase when large cogeneration plants are installed. The cogeneration plants will produce both electricity and the steam required for the thermal EOR projects. These plants will be centralized and the initial steam flow will be large and must be divided into the individual flows for various injection wells. These centralized plants will require that the initial distribution of steam be through large diameter main flowlines.

In the prior art, for example, U.S. Pat. No. 3,899,000 suggests that a two-phase vapor-liquid mixture could be separated into two or more individual flows by use of a closed vessel. The vessel is mounted vertically and provided with a top inlet and two or more bottom outlets. A flat horizontal baffle is used to divert the inlet flow from the open ends of the outlets. The axis of the inlet and the axis of the outlets are substantially parallel so the flow of the fluid is axially through an elongated vessel. The vapor-liquid ratio is maintained by using the outlets as standpipes and the vessel as a reservoir. Once sufficient liquid collects in the bottom of the vessel it can overflow side outlets in the standpipes and liquid will be added to the vapor flowing out of the outlets. While this system may be satisfactory it does rely upon the condensed liquid partially separating from the vapor with subsequent recombination with the vapor. This will be ineffective if the vessel is not vertical and unequal distribution of liquid and vapor can result. Also, the use of baffles to change the flow direction can cause excessive pressure losses.

SUMMARY OF THE INVENTION

The present invention provides an apparatus for separating or splitting a vapor-liquid stream into multiple individual streams which have substantially the same vapor-liquid ratio. The stream may be a two-phase, vapor-liquid or may be a multiphase vapor-liquid stream. The apparatus uses an inlet static mixer to thoroughly mix liquid and distribute it throughout the vapor. The thoroughly mixed vapor-liquid is introduced into the top of a closed vertical vessel, preferably a cylindrical vessel. The mixture flows into the vessel striking a flat sided frustum shaped member that is mounted in the bottom of the vessel with its apex extending upwardly toward the inlet. The frustum shaped member diverts the vapor-liquid mixture radially into the outlets that are equally spaced around the side wall of the vessel. The use of the diverter element ensures that the flow entering the top of the vessel will be proportionally distributed to the individual radial outlets while reducing the residence time. Normally, the flow to individual wells will be unequal, with each flow containing a proportionate share of the liquid. Drain or weep holes are provided along the bottom edge of the diverter element so that any liquid that is separated from the vapor-liquid mixture can flow into the bottom of the vessel where it can be drained through a suitable outlet. The use of a drain ensures that the flow through the individual outlets will be of substantially as high quality as the entering vapor-liquid mixture and in some instances of higher quality. The drain also provides blowdown for the branch line from the main line to the vessel. Condensate can then be disposed of or reclaimed.

BRIEF DESCRIPTION OF THE DRAWINGS

The invention will be more easily understood from the following detailed description when taken in conjunction with the attached drawings in which:

FIG. 1 is an elevation view of the apparatus shown partially in section.

FIG. 2 is a plan view of the apparatus also shown partially in section.

DESCRIPTION OF THE PREFERRED EMBODIMENT

Referring to the drawing, there is shown a cylindrical pressure vessel 10 having dome or elliptical shaped ends or heads 16 and 17. The vessel is mounted vertically and provided with a central inlet 11 in the top 16 for the vapor-liquid mixture that is to be divided into individual streams. The vessel is also provided with a plurality of outlets 12 which extend radially out from the sidewall of the vessel. In addition, the outlets are equally spaced around the circumference of the vessel as shown in FIG. 2. The outlets preferably have the same diameter with the flow in each outlet being controlled by metering valves for the individual wells. A drain outlet 13 is connected to the bottom end 17 of the vessel and is used to drain any liquid that separates from the fluid in the vessel.

The apparatus uses a static mixture 14 which is positioned immediately above the inlet 11. The static mixer is designed to thoroughly distribute the liquid throughout the vapor in the fluid before it enters the vessel 10. Suitable static mixers can be the mixer marketed by Komax Systems, Inc. of Long Beach, Calf., as their Komax® Triple Action Motionless Mixer. Also, the mixer shown in copending application Ser. No. 06/476,742 filed Mar. 18, 1983, entitled "MIXING APPARATUS" and assigned to the same assignee as the present invention could be used.

After flowing into the vessel the fluid strikes the diverter element 15 which has a generally frustum shape. The diverter element 15 is mounted in the vessel so that its lower edge substantially fills or blocks the bottom of the vessel while its upper end, or apex, extends above the level of the individual outlets 12 and is approximately at the same level as the seam between the top head and the sidewall of the vessel.

The diverter element 15 is formed from a plurality of flat plate members 20 whose edges are joined together to form the conical diverter element. As shown in FIG. 2, eight elements are used to form the conical diverter element when eight individual outlet streams are utilized. The exact number of faces of the conical element are a matter of design choice although it is preferable to have one face per outlet. Also, if desirable, the diverter element could be formed as a true conical element with a coninuous or rounded outer surface although this would be more difficult to fabricate. The lower edge 21 of the diverter element is attached to the inner wall of the vessel 10 by welding or the like.

As shown, a portion of the lower edge of each of the flat plates 20 is relieved at 22 so that the adjacent plates when joined together and to the sidewall of the vessel will provided a drain opening 23 through which the liquid separated from the fluid can drain. This ensures that any liquid that separates from the fluid will drain downwardly and exit through the spaces 23 and collect in the bottom section 24 of the vessel. From this position it can be drained through the line 13 which may have a valve 26 disposed therein to control the flow. In addition, the valve 26 could be responsive to the liquid level in the vessel 10 to drain the vessel when the level rises to a certain position. A conventional steam trap may be used for draining the vessel in place of the float controlled valve 26.

The system is operated by flowing the vapor-liquid mixture through the static mixer 14 into the vessel 10. The fluid passes through the static mixing device 14 to evenly distribute the liquid throughout the vapor phase of the fluid. As the mixture passes into the vessel 10, it strikes the diverter element 15 which forces the mixture outwardly through the individual outlets 12. As shown, the inlet 11 is coaxial with the axis of the diverter element 15 so that the mixture will be evenly distributed to all of the outlets 12. The equal distribution is assisted by spacing the outlets equally around the circumference of the vessel 10 to equalize the flow paths. The flow rate through each of the individual outlets will be substantially the same and the vapor-liquid ratio will be the same.

Also, since the mixture is thoroughly mixed before it is introduced into the vessel 10, substantially all of the liquid will flow out the individual inlets 12 and only a small portion will be collected in the bottom 24 of the vessel. The liquid collected in the vessel can be periodically drained through the drain line 13. The combination of the diverter 15 and the equal circumferential spacing of the outlets provides substantially uniform quality. This is important in thermal enhanced oil recovery processes using wet steam where it is essential that each well receive substantially the same quality of steam. It is also desirable to split the main steam flow into the individual flows with least loss of pressure.

It is possible to modify the apparatus of the present invention by eliminating the drain holes 23 and drain line 13. When the drain holes are eliminated the outlets 12 should be moved nearer to the bottom edge of the diverter 20 to assist in proportionally distributing any liquid between the outlets. Of course, any liquid that collects in the bottom of the vessel 10 will flow out the outlets 12. A small vent opening should be formed in the top of the diverter 15 to equalize the pressure between the top and bottom of the vessel 10. To ensure proportional distribution of the liquid to the outlets 12, the vessel 10 must be mounted vertically with all of the outlets in the same horizontal plane. Of course, with equal flows in all outlets the liquid will be equally distributed between all outlets.

What is claimed is:

1. An apparatus for dividing wet steam mixture into a plurality of individual streams while maintaining substantially the same vapor-liquid ratio in each stream, said apparatus comprising:

a closed vertical cylindrical vessel having a central inlet in the top surface, the source of said wet steam being coupled to said inlet;

a plurality of outlets distributed around the side wall of said vessel;

a diverting member, said diverting member having a generally frustum shape, said diverting member being mounted in said closed vessel with the apex of the frustum extending upwardly and the top surface of said diverting member being located above the position of said outlets and the bottom end of the diverting member extending below said outlets; and an outlet drain located in the bottom of said vessel below the bottom end of the diverting member.

2. The apparatus of claim 1 wherein the bottom end of the diverting member conforms substantially to the interior configuration of the vessel and small drain openings are provided between the bottom edge of said diverting member and the wall of said vessel.

3. The apparatus of claim 1 and in addition a static mixing means installed immediately prior to the inlet to the vessel to thoroughly mix the vapor and liquid.

4. The apparatus of claim 1 wherein said diverting member is formed from a plurality of flat panels.

5. The apparatus of claim 4 wherein said panels have a portion of their lower edge that conforms to the configuration of the side wall of the vessel and a portion that is relieved, said relieved portion forming said drain openings.

6. The apparatus of claim 5 wherein the portion of the lower edge of said panels that conforms to the configuration of the side wall is fastened to said side wall to support said diverting member in said vessel.

7. The apparatus of claim 1 wherein said vessel has elliptical shaped ends.

8. The apparatus of claim 7 wherein said inlet is substantially vertical and said outlets are substantially horizontal.

9. The apparatus of claim 8 wherein said outlets are equally spaced around the circumference of the vessel and extend raidally outward.

10. An apparatus for dividing a wet steam mixture into a plurality of individual streams while maintaining substantially the same vapor-liquid ratio in each stream, said apparatus comprising:

a static mixing device, said wet steam being coupled to said mixing device;

a closed vertical cylindrical vessel having a central inlet in the top surface, said mixing device being coupled to said inlet;

a plurality of outlets distributed around the sidewall of said vessel; and a diverting member, said diverting member having a generally frustum shape, said diverting member being mounted in said closed vessel with the apex of the frustum extending upwardly and the top surface of said diverting member being located above the position of said outlets and the bottom end of the diverting member being adjacent said outlets.

11. A method for separating a wet steam mixture into a plurality of individual streams while maintaining substantially the same vapor-liquid ratio in each individual stream, said method comprising:

thoroughly mixing said wet steam;

introducing said thoroughly mixed wet steam into a closed vessel along a first axis;

diverting said mixed wet steam from a said first axis to a second axis;

withdrawing said wet steam from said vessel through a series of outlets along a third axis at an angle to said first axis; and removing from the vessel any liquid that separates from the wet steam mixture.

12. The method of claim 11 wherein said third axis is at right angles to said first axis.

* * * * *